United States Patent [19]

Templeton

[11] Patent Number: 4,787,562

[45] Date of Patent: Nov. 29, 1988

[54] GRINDING MILL WITH MEANS FOR DAMPING ROLLER DISPLACEMENT

[75] Inventor: John Templeton, Colinslee Crescent, United Kingdom

[73] Assignee: Charles W. Taylor & Son Limited, Tyne and Wear, United Kingdom

[21] Appl. No.: 84,214

[22] Filed: Aug. 12, 1987

[30] Foreign Application Priority Data

Aug. 23, 1986 [GB] United Kingdom ..... 8620561

[51] Int. Cl.[4] ..... B02C 15/12

[52] U.S. Cl. ..... 241/117; 241/DIG. 30

[58] Field of Search ..... 241/DIG. 30, 117–121, 241/290, 300, 123–133

[56] References Cited

U.S. PATENT DOCUMENTS 2,115,314 4/1938 McErlean ..... 241/DIG. 30 X

FOREIGN PATENT DOCUMENTS 402854 12/1933 United Kingdom ... 241/DIG. 30 X 1054249 1/1967 United Kingdom .

*Primary Examiner*—Mark Rosenbaum

*Attorney, Agent, or Firm*—Dennison, Messerole, Pollack & Scheiner

[57] ABSTRACT

A vertical spindle type grinding mill for example for crushing coal comprises upper and lower rings 1, 2 together defining a track for rolling grinding members 3 and yokes 7, 4 bearing against the upper and lower rings 1, 2 for resisting forces tending to separate them. A drive is provided via main shaft 8, for effecting relative rotation between the rings. At least one yoke, preferably the lower yoke 4, bears against its associated ring 2 via interposed elastomeric material 6. This reduces the risk of brittle fracture when using hard relatively brittle alloys for the manufacture of the upper and lower rings so that they have increased wear resistance.

3 Claims, 2 Drawing Sheets

GRINDING MILL WITH MEANS FOR DAMPING ROLLER DISPLACEMENT

Figure 1:
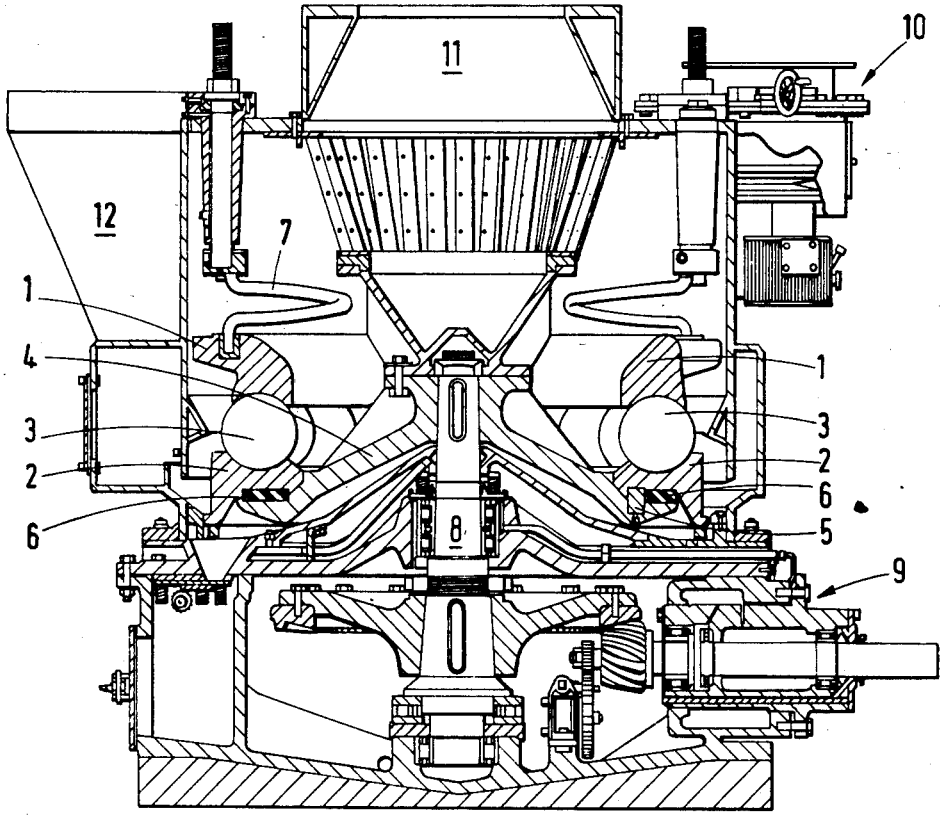

This invention relates to grinding mills, and in particular to vertical spindle type mills. Such mills are useful for crushing various minerals, for example coal.

There are variations within the design of vertical spindle mills where the grinding means consists of balls or rollers located between two grinding rings which may for example be some 3 meters in diameters. In one typical design, an upper ring is restrained from turning by various means, but is allowed to move vertically in a controller manner to compensate for wear in the grinding components. The other grinding ring i.e. the lower ring, is driven in rotation about a generally vertical axis by a mainshaft via a yoke casting or other fabrication, which supports the components in the grinding zone. The main shaft is driven through a gear box, which may be integral with the mill components, but in the larger mills which are now in service, the gear box is an independent component which can be removed easily from the mill without dismantling the main mill structure.

The grinding flow path is generally as follows. The raw coal enters the mill through a vertical coal chute and lands either on a flat revolving table i.e. yoke, or on the sloping face of a conical yoke. As the lower grinding ring is the rotating vehicle, the coal on landing is fed radially outwards in all directions, through centrifugal force and/or gravity, and is ground between the balls or rollers and the lower grinding ring and the ground coal is expelled from the mill by pressurised high temperature air.

The load that crushes the coal may be imparted to the upper ring through coil springs or hydro-pneumatic cylinders.

Magnetic separators are sometimes installed at the grinding site. These separators are intended to remove all foreign ungrindable matter from the coal prior to the coal; entering the mill. If such separators are absent, or if they are not functioning properly, variable amounts of ungrindable matter may find their way into the mill.

Thus, as well as the coal being fed radially outwards to the ball or roller track of the grinind rings, all the foreign matter, e.g. relatively hard 37 ungrindable" material, in the coal also moves radially through the track. This causes the grinding ball or roller to rise to clear the relatively hard object and in so doing the loading is slightly increased as the ball lifts from its normal position.

Irrespective of the design variances, this type of mill is therefore subject to varying induced dynamic loads. The dynamic loading will depend on the operating conditions.

As the ball or roller is completely unrestrained other than by the track, it is returned to the track under an accelerating action from the loading appliance on the mill. The dynamic force thus generated does not fall concentrically to the centre line of the mill; on the contrary, the force acts at a distance equal to the pitch circle radius of the ball or roller track.

It should be noted that a dynamic bending moment is thus imparted to the lower grinding ring and since the other balls or rollers on the track are not vertically disturbed while the dynamic action by one ball or roller is taking place, the remaining balls or rollers under the normal applied load will provide a reaction force thus creating a dynamic bending moment acting through the centre line of the mill at right angles to the dynamic force causing the grinding ring section to suffer force of a tensile nature at the upper edges of the ring.

Now it is recognised that alloy iron materials such as that available under the Trade Name Ni-hard, which have a high Brunel hardness and thus a high resistance to wear give the best potential useful working life to the ring, are not suited to be subjected to such forces, since they are liable to breakage. This results in the premature failure of a number of rings, mainly lower rings, before their full potential working life has been reached.

Various attempts have already been tried to solve this breakage problem by making the rings of less brittle materials, and by thickening the supporting sections of the grinding ring support table i.e. the yoke section, in the hope of diminishing the dynamic bending moment.

For example, many mills are run with alloy steel rings which are generally reliable structurally in that they are more resistant to breakage. However, these rings are not so wear resistant as the high hardness alloy iron rings, and so they have to be changed more frequently than would the alloy iron rings.

It should be realised that the grinding action generates a kinetic energy input to the whole mill support system including foundations and it is desirable that this energy be absorbed in a gradual manner. It should also be realised that the thickening of supporting yokes, whilst reducing the deflection of the yoke and grinding ring, results in the imparting of a greater dynamic load. Therefore, neither of these previously proposed remedies is in itself a workable solution to the problems encountered.

It is also the case that heavier impact loads can cause a circumferential bending action should the ring and yoke sections deflect differently. If the yoke is stiffer than the ring then the ring will be lifted under the dynamic type bending moment. If the yoke is not as stiff as the ring then the forces acting between ring and yoke parts and a local bending moment acting round part of the circumference could cause breakage of the ring.

It is an object of this invention to alleviate the problems referred to above.

According to this invention, there is provided a vertical spindle type grinding mill comprising upper and lower rings together defining a track for rolling grinding members, yoke means bearing against the upper and lower rings for resisting forces tending to separate such rings and means for effecting relative rotation between said rings, characterised in that said yoke means bears against at least one said ring via interposed elastomeric material.

Various synthetic elastomeric compounds can cater for the air temperature anticipated at a ring/yoke interface.

Advantages afforded by the present invention, at least in its preferred embodiments are as follows:

Dynamic load falls by approximately 60% when elastomeric pads are used as against metal to metal contact at the interface of the yoke with the lower ring.

When dynamic force occurs this will induce a certain deflection at the impact point such that at 180° from this point the pad deflection will be created by the static load conditions. There are generally 9 or 10 balls or rollers in large mills and the effect of the pad means that the dynamic load and energy is shared right round the complete circumference.

In this way the following advantages are obtained:

Dynamic loading in the exemplified case drops by 60%. There is no loss of contact between ring and yoke right round the circumference and, therefore, circumferential bending moment is eliminated. Vibrations will be reduced due to the drop in induced loading, and noise levels should drop significally.

It is preferred that elastomeric material is interposed between the lower ring and its associated yoke means.

In order to allow for change of shape in elastomer and ready replacement, the complete pad is preferably made up in a certain number of segments. Between adjacent segments there is preferably a gap to accommodate increase in plane area due to decrease in thickness of pad locally under load.

Figure 2:
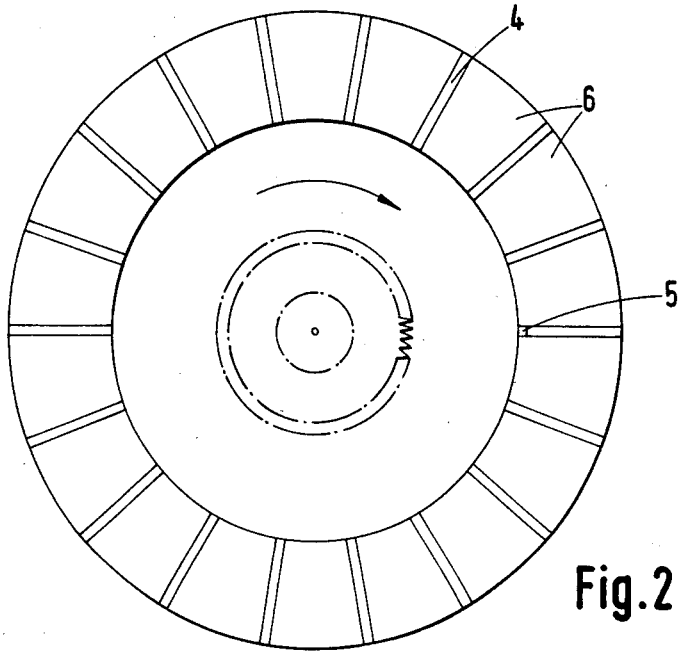
Figure 3:
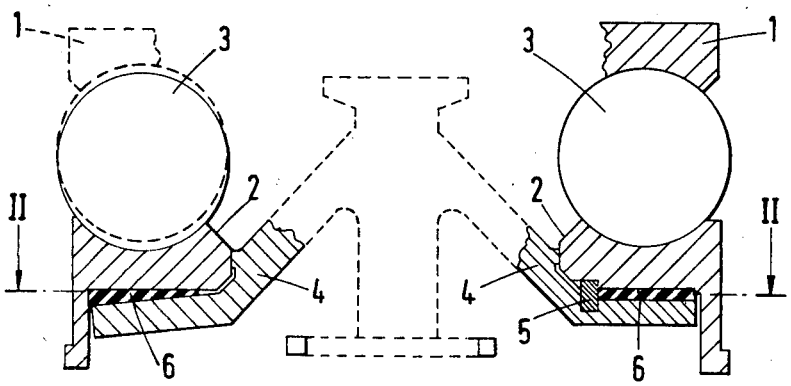

In the accompanying diagrammatic drawings,

FIG. 1 is a vertical cross section through a vertical spindle mill according to the invention, and FIG. 2 is a plan view on the line II—II of FIG. 3 which in turn is a schematic partial vertical cross section through the mill of FIG. 1, showing upper and lower rings defining a track and a yoke supporting the lower ring.

The vertical spindle coal grinding mill shown in FIG. 1 comprises upper and lower grinding rings 1, 2 which locate a set of grinding balls 3. The lower ring 2 is supported by a yoke 4 and is prevented from rotating relative to the yoke 4 by means of dowels such as 5. In accordance with the invention, elastomeric material 6 is interposed between the yoke 4 and that lower ring 2.

This reduces the risk of brittle fracture when using hard relatively brittle alloys for the manufacture of the upper and lower rings so that they have increased wear resistance.

The upper ring 1 is restrained from turning by a yoke comprising spring mountings such as 7, but is allowed to move vertically in a controlled manner to compensate for any wear in the grinding components. The lower ring 2 is driven in rotation about a generally vertical axis by a main shaft 8 via the yoke 4 which supports the components in the grinding zone. The main shaft 8 is driven through a gear box 9, which may be integral with the mill components, but which is preferably an independent component which can be removed easily from the mill without dismantling the main mill structure.

The raw coal enters the mill through a coal chute terminating in an adjustable gate 10 known per se. The coal is then fed at the desired rate via a chute to land on the sloping face of the conical yoke 4. As yoke 4 is the rotating vehicle, the coal on landing is fed radially outwards in all directions, through centrifugal force and/or gravity, and is ground between the balls 3 and the lower grinding ring 2. The ground coal is expelled from the mill through a vertical coal outlet 11 by pressurised high temperature air fed into the mill by air ducting 12.

The elastomeric material 6 is arranged in spaced annular segments around the yoke 4, as shown in FIG. 2. This allows ready replacement of the elastomer, and lateral expansion thereof when it is compressed vertically, for example as shown to the left of FIG. 3, due to the presence of relatively hard material present as an impurity which resists being crushed.

By virtue of the presence of the elastomeric material 6, stresses occasioned by the passage through the track of material which is too hard to be crushed will be more evenly distributed around the track and as a result the dynamic loading will be substantially reduced, thus reducing stresses in the yoke and contributing to an increased working life.

What is claimed is:

1. A vertical spindle type grinding mill which comprises in combination, upper and lower rings together defining a track, rolling grinding means on said track, yoke means supporting the upper and lower rings for resisting forces tending to separate such rings, means for holding the upper ring against rotation and for exerting vertical pressure thereon, drive means for effecting rotation of said lower ring via the lower of said yoke means and elastomeric material interposed between such lower yoke means and said lower ring to distribute and absorb dynamic bending forces in said lower ring due to vertical displacement of said rolling grinding means.

2. A mill according to claim 1, wherein said elastomeric material is in the form of annular segmental pads.

3. A mill according to claim 2, wherein said pads are arranged in spaced manner around the ring.

* * * * *